United States Patent [19]

Lipschutz

[11] 4,363,230

[45] Dec. 14, 1982

[54] CYLINDRICAL LOCKS

[75] Inventor: Paul Lipschutz, Croissy, France

[73] Assignee: SODEX-MAGISTER, Societe d'Exploitation des Brevets Neiman, Croissy, France

[21] Appl. No.: 192,289

[22] Filed: Sep. 30, 1980

[30] Foreign Application Priority Data

Oct. 8, 1979 [FR] France ..... 79 24951

[51] Int. Cl.[3] ..... E05B 9/08

[52] U.S. Cl. ..... 70/370; 70/451

[58] Field of Search ..... 70/451, 370, 372, 447, 70/448, 367; 248/27

[56] References Cited

FOREIGN PATENT DOCUMENTS 1428528 11/1968 Fed. Rep. of Germany ..... 70/370

2162425 6/1973 Fed. Rep. of Germany ..... 70/370

*Primary Examiner*—Robert L. Wolfe

*Attorney, Agent, or Firm*—James C. Wray

[57] ABSTRACT

The invention relates to a cylindrical lock of the type comprising a barrel journalling in the bore of a body.

In the lock to which the invention relates, the peripheral surface of the barrel and the surface of the bore in the body comprise an assembly consisting of an elastic longitudinal tongue and a shoulder which are respectively integral with the said two surfaces and which are arranged in such a manner that the said elastic tongue interacts with the said shoulder to lock the barrel so that it cannot move longitudinally in relation to the body.

Application to the car industry.

3 Claims, 3 Drawing Figures

CYLINDRICAL LOCKS

BACKGROUND TO THE INVENTION

The invention relates to a cylindrical lock of the type comprising a barrel journalling in the bore of a body.

One of the serious problems involved in these locks is how to immobilize the barrel in the axial direction in relation to the body by means inaccessible or difficult of access from the outside, in order to keep the lock inviolable. The barrel is generally immobilized by means of a supplementary device such as a circlip, a stub engaging a groove, an elastic bolt of the "lock plate" type which can be moved out of the way, etc. Even if most of these devices prove satisfactory, the cost of the lock is increased not only by that of the device itself but also by the expense involved in assembling it.

OBJECT OF THE INVENTION

The object of the present invention is to improve the locks of the aforementioned type and to reduce their cost.

SUMMARY OF THE INVENTION

According to the invention there is provided a cylinder lock comprising a body and a barrel journalled within a bore in said body a resilient tongue extending longitudinally of the barrel, said tongue being formed integrally with said barrel and having an exterior surface of part cylindrical shape conforming to the cylindrical of the exterior of the barrel, when in its normal position a shoulder formed within the bore of the body remote from the end of the bore through which the bore enters during assembly of the barrel within the bore, and a nose formed integrally with said tongue at the distal end thereof, whereby on initial entry of the barrel with the bore during assembly the distal end of the tongue deforms away from its normal position towards the barrel and on completion of the barrel assembly operation the tongue returns to its normal position whereupon the nose engages the shoulder to prevent withdrawl of the barrel.

BRIEF DESCRIPTION OF DRAWINGS

The invention will be clearly understood from the following description given by reference to the accompanying drawing, in which.

DESCRIPTION OF PREFERRED EMBODIMENT

Figure 3:
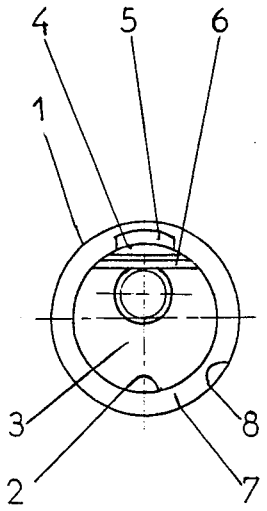
FIG. 3 is an end view of the lock shown in FIGS. 1 and 2.

The lock comprises a body 1 provided with a longitudinal bore 2 in which is journalled a barrel 3. In the version shown the barrel comprises an elastic longitudinal tongue 4 terminating in a nose 5 farther inside the lock. The tongue 4, which is integral with the barrel, is separated from the latter by a gap 6 and can approach the barrel with an elastic movement. The bore 2 in the body 1 comprises a circular shoulder 7 formed by a widened portion 8 in which the bore continues inside the lock.

Figure 2:
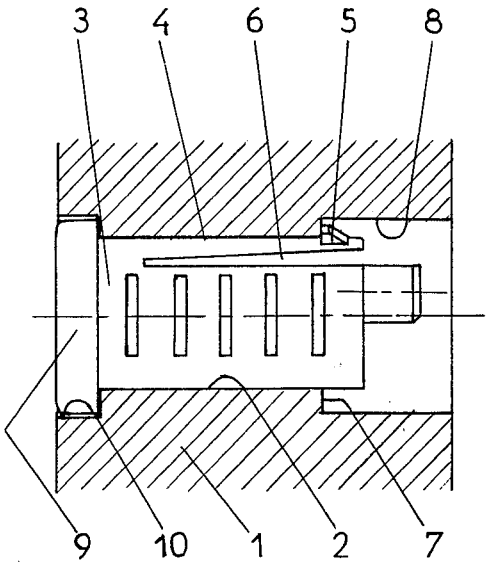
FIG. 2 is an analogous diagram to FIG. 1 but shows the lock after it has been assembled.
Figure 1:
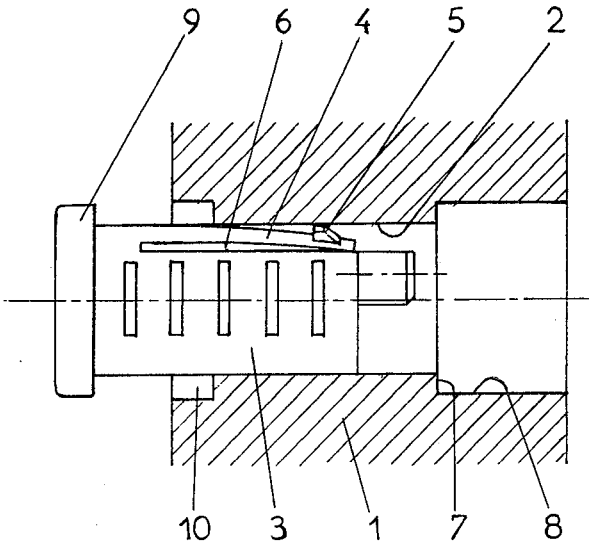
FIG. 1 is a schematic longitudinal section, partly in elevation, of a lock according to one version of the invention, shown in the course of its assembly.

In the assembly process shown in FIG. 1 the nose 5 slides along the bore 2, deflecting the tongue 4 towards the barrel 3. As soon as the nose 5 has passed the shoulder 7 the tongue 4 is released and the nose 5 has passed the shoulder 7 the tongue 4 is released and the nose 5 engages behind the shoulder. The barrel is thus secured against any longitudinal motion in respect of the body, as shown in FIGS. 2 and 3.

The head of the barrel 3 is provided, in accordance with conventional systems, with a thickened portion 9 accommodated in a groove 10 in the body 1. Access to the bore 2 and thus to the tongue 4 from outside the lock is thereby prevented.

I claim:

1. In a cylinder lock of the type comprising a body and a barrel journalled within a bore in said body, the provision of (a) a resilient tongue extending longitudinally of the barrel, said tongue being formed integrally with said barrel and having an exterior surface of part cylindrical shape conforming to the cylindrical shape of the exterior of the barrel when in its normal position, (b) a shoulder formed within the bore of the body remote from the end of the bore through which the bore enters during assembly of the barrel within the bore, and (c) a nose formed integrally with said tongue at the distal end thereof, whereby on initial entry of the barrel into the bore during assembly the distal end of the tongue deforms away from its normal position towards the barrel and on completion of the barrel assembly operation, the tongue returns to its normal position whereupon the nose engages the shoulder to prevent withdrawl of the barrel.

2. A cylinder lock according to claim 1 wherein said bore is provided with an annular recess at the end remote from the shoulder and said barrel is provided with an enlarged cylindrical portion which seats within said annular recess in the assembled condition.

3. A method of forming a barrel for a cylinder lock of the kind having a body formed with a bore towards one end of which is formed a shoulder, comprising (a) forming a cylindrical barrel, (b) forming in said barrel an elongated gap extending longitudinally of the barrel along a substantial portion thereof thereby resulting in an elastically deformable tongue integral with said barrel having a cylindrical outer surface conforming to the remainder of the exterior surface of the barrel, and (c) forming a nose on said tongue at the distal end of said tongue, which nose serves to engage the shoulder after assembly of the barrel within the body.

* * * * *